US010205254B2

(12) United States Patent
Wang

(10) Patent No.: US 10,205,254 B2
(45) Date of Patent: Feb. 12, 2019

(54) ELECTRICAL CONNECTOR AND METHOD OF MAKING THE SAME

(71) Applicant: FOXCONN INTERCONNECT TECHNOLOGY LIMITED, Grand Cayman (KY)

(72) Inventor: Cai-Yuan Wang, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/636,672

(22) Filed: Jun. 29, 2017

(65) Prior Publication Data

US 2018/0006386 A1 Jan. 4, 2018

(30) Foreign Application Priority Data

Jun. 29, 2016 (CN) ..... 2016 1 0490526

(51) Int. Cl.

| | |
|---|---|
| ***H01R 13/52*** | (2006.01) |
| ***H01R 13/62*** | (2006.01) |
| ***H01R 9/03*** | (2006.01) |
| ***H01R 4/04*** | (2006.01) |
| ***H01R 13/533*** | (2006.01) |
| *H01R 43/00* | (2006.01) |

(52) U.S. Cl.

CPC ..... *H01R 9/032* (2013.01); *H01R 4/04* (2013.01); *H01R 13/533* (2013.01); *H01R 13/62* (2013.01); *H01R 43/005* (2013.01); *H01R 43/00* (2013.01)

(58) Field of Classification Search

CPC ..... H01R 13/6593; H01R 13/6581; H01R 13/658; H01R 9/038; H01R 43/24; H01R 13/521; H01R 43/05

See application file for complete search history.

(56) References Cited

U.S. PATENT DOCUMENTS

| | | | | |
|---|---|---|---|---|
| 9,093,797 | B2 * | 7/2015 | Zhao | H01R 12/707 |
| 9,385,484 | B2 * | 7/2016 | Chen | H01R 13/6594 |
| 9,391,391 | B2 * | 7/2016 | Chien | H01R 13/5202 |
| 9,429,360 | B2 * | 8/2016 | Hsiao | F26B 3/28 |
| 9,647,369 | B2 * | 5/2017 | Tsai | H01R 4/02 |
| 9,728,961 | B2 * | 8/2017 | Hehenberger | H02J 3/01 |
| 2013/0183844 | A1 * | 7/2013 | Wang | H01R 24/68 439/271 |
| 2016/0155945 | A1 | 6/2016 | Lin et al. | |
| 2016/0211625 | A1 * | 7/2016 | Sharf | H01R 12/721 |

(Continued)

FOREIGN PATENT DOCUMENTS

| | | | |
|---|---|---|---|
| CN | 1691877 | A | 11/2005 |
| CN | 103208698 | A | 7/2013 |
| CN | 103972719 | A | 8/2014 |

(Continued)

*Primary Examiner* — Xuong Chung Trans

(74) *Attorney, Agent, or Firm* — Wei Te Chung; Ming Chieh Chang

(57) ABSTRACT

An electrical connector includes: an insulative housing having a base portion and a tongue portion; plural contacts affixed to the insulative housing and exposed to the tongue portion; a metal shielding plate affixed to the insulative housing; and a shielding shell enclosing the insulative housing; wherein at least one of the plurality of contacts, the metal shielding plate, and the shielding shell is covered by thermostable conductive adhesives.

9 Claims, 12 Drawing Sheets

(56) References Cited

U.S. PATENT DOCUMENTS

2017/0164511 A1* 6/2017 Bucher ..... G02B 6/4272

FOREIGN PATENT DOCUMENTS

| | | | |
|---|---|---|---|
| CN | 204927628 | U | 12/2015 |
| CN | 105449444 | A | 3/2016 |
| CN | 105552618 | A | 5/2016 |
| CN | 105655786 | A | 6/2016 |
| CN | 205303806 | U | 6/2016 |
| TW | M478274 | | 5/2014 |
| TW | M517445 | | 2/2016 |

* cited by examiner

ELECTRICAL CONNECTOR AND METHOD OF MAKING THE SAME

BACKGROUND OF THE INVENTION

1. Field of the Invention

The present invention relates to an electrical connector adapted for normally and reversely mating with a mating connector and a method of making the same.

2. Description of Related Arts

China Patent No. 204927628, issued on Dec. 30, 2015, discloses an electrical connector comprising a first insulator and a second insulator, a row of upper contacts affixed to the first insulator and a row of lower contacts affixed to the second insulator, and a metal shielding plate clamped between the first insulator and the second insulator. The first insulator and the second insulator are further molded with plastics.

An improved electrical connector is desired.

SUMMARY OF THE INVENTION

An electrical connector comprises: an insulative housing having a base portion and a tongue portion; a plurality of contacts affixed to the insulative housing and exposed to the tongue portion; a metal shielding plate affixed to the insulative housing; and a shielding shell enclosing the insulative housing; wherein at least one of the plurality of contacts, the metal shielding plate, and the shielding shell is covered by thermostable conductive adhesives. With the plurality of contacts, the metal shielding plate, or the shielding shell covered by thermostable conductive adhesives to ensure stability of insulative materials, when the electrical connector is mated with a mating connector, the electrical connector can effectively prevent the contacts, the metal shielding plate, or the shielding shell from separating from insulative materials due to effect of high temperature.

DETAILED DESCRIPTION OF THE PREFERRED EMBODIMENT

Figure 1:
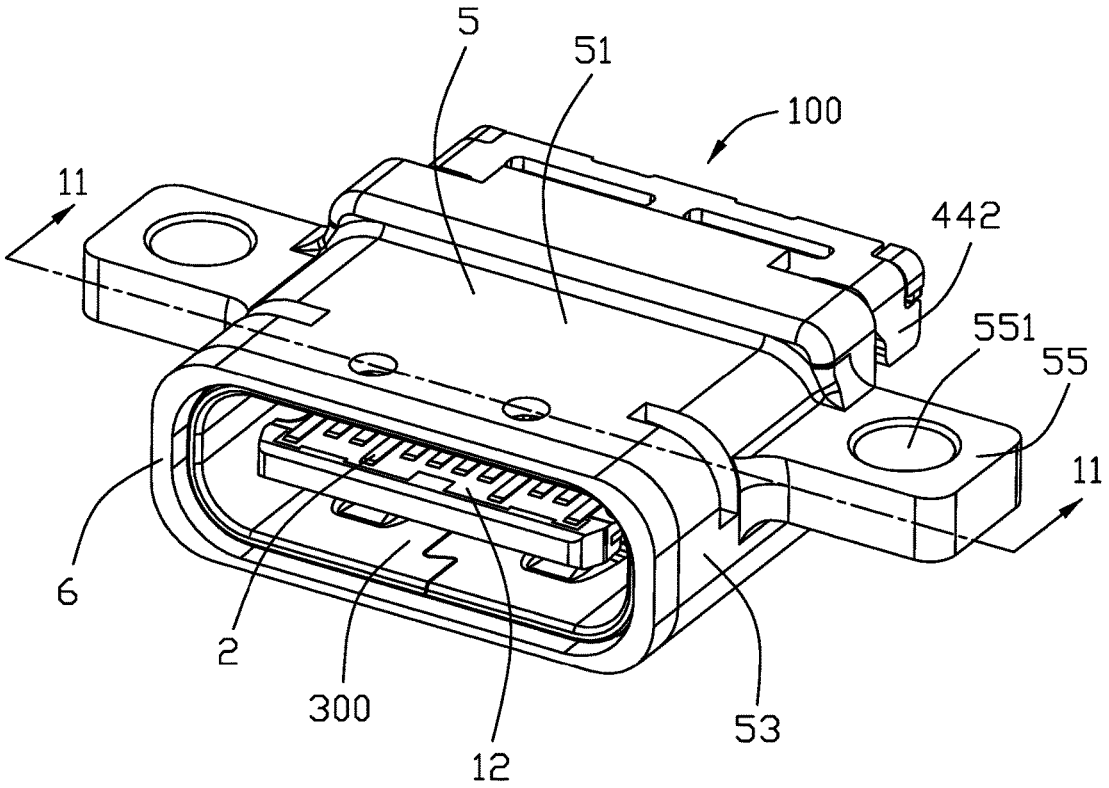
FIG. 1 is a perspective, assembled view of an electrical connector.
Figure 2:
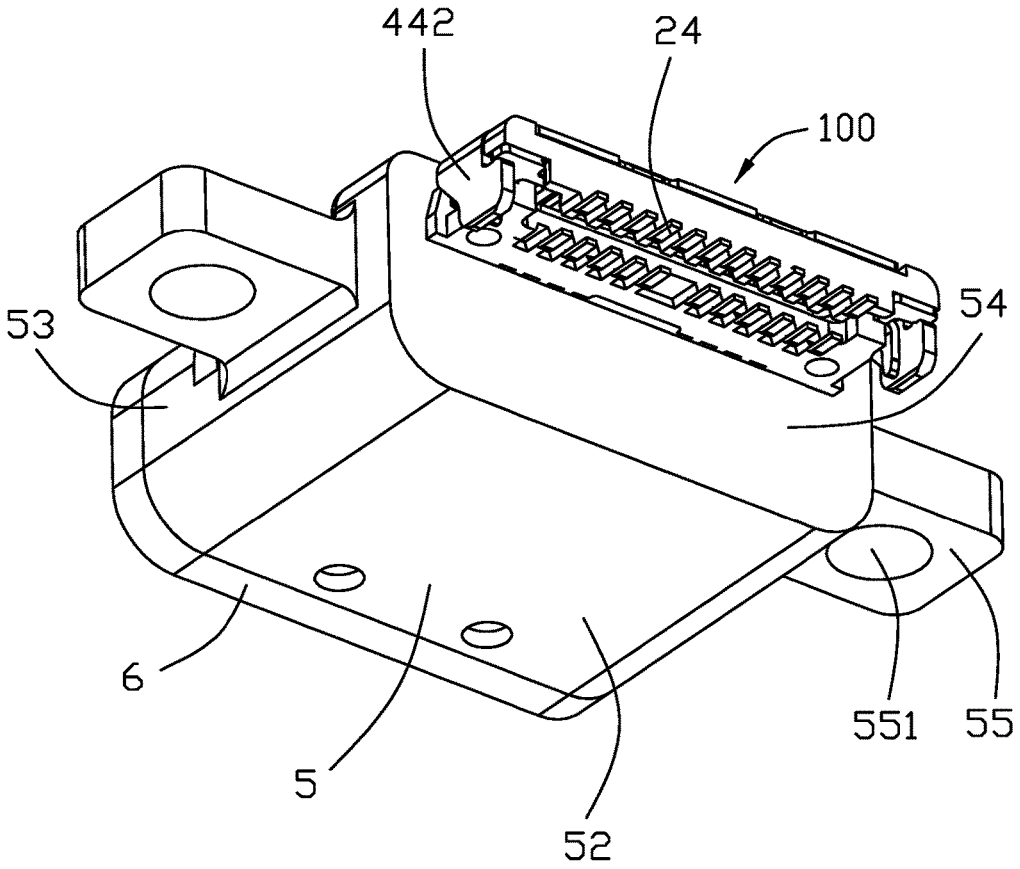
FIG. 2 is another perspective, assembled view of the electrical connector taken from FIG. 1.

Referring to FIGS. 1 to 10, an electrical connector 100 includes a receptacle connector 200, an insulative shell 5 fitted to the outside of the receptacle connector 200, and a sealer 6 located at the front end of the insulative shell 5. The receptacle connector 200 includes an insulative housing 1, a plurality of contacts 2 affixed to the insulative housing 1 as a contact module, a metal shielding plate 3 affixed to the insulative housing 1, and a shielding shell 4 enclosing the insulative housing 1. In other embodiments, the electrical connector 100 further includes a plastic plate (not shown).

Referring to FIGS. 5 to 8, the insulative housing 1 includes a base portion 11 and a tongue portion 12 extending forwardly from the base portion 11. The base portion 11 includes a pair of receiving grooves 153 depressed downwardly from an upper surface thereof, a pair of recesses 154 depressed upwardly from a lower surface thereof, and a notch 148 located at a rear end of recesses 154 and depressed upwardly. The insulative housing 1 further includes a first insulator 13, a second insulator 14, and a third insulator 15. The first insulator 13 includes a first base 131 and a first tongue 132 extending forwardly from the first base 131. The first base 131 includes a holding block 133, a pair of first locking portions 134 on both sides of a rear end of the holding block 133, and a pair of first mated holes 135 located at the front end of first locking portions 134. The first tongue 132 includes a locking hole 136 located at a front end thereof. The second insulator 14 includes a second base 141 and a second tongue 142 extending forwardly from the second base 141. The second base 141 includes a pair of second locking portions 143 located at a rear end thereof and extending upwardly from an upper surface thereof, a pair of second mated holes 144 located at a front end of second locking portions 143, a pair of stopper barriers 145 located at a front end of second mated holes 144 and extending upwardly, and the notch 148 depressed upwardly from a lower surface thereof. The pair of stopper barriers 145 are enclosed to form a receiving space 146. The second tongue 142 includes a clamping block 147 located at a front end thereof and extending upwardly. The third insulator 15 includes a third base 151 and a third tongue 152 extending forwardly from the third base 151. The third base 151 includes the pair of receiving grooves 153 located at an upper surface thereof, and the pair of recesses 154 located at a lower surface thereof. The third tongue 152 includes a hollow section 155 and a pair of fixed grooves 156 on both sides.

Figure 9:
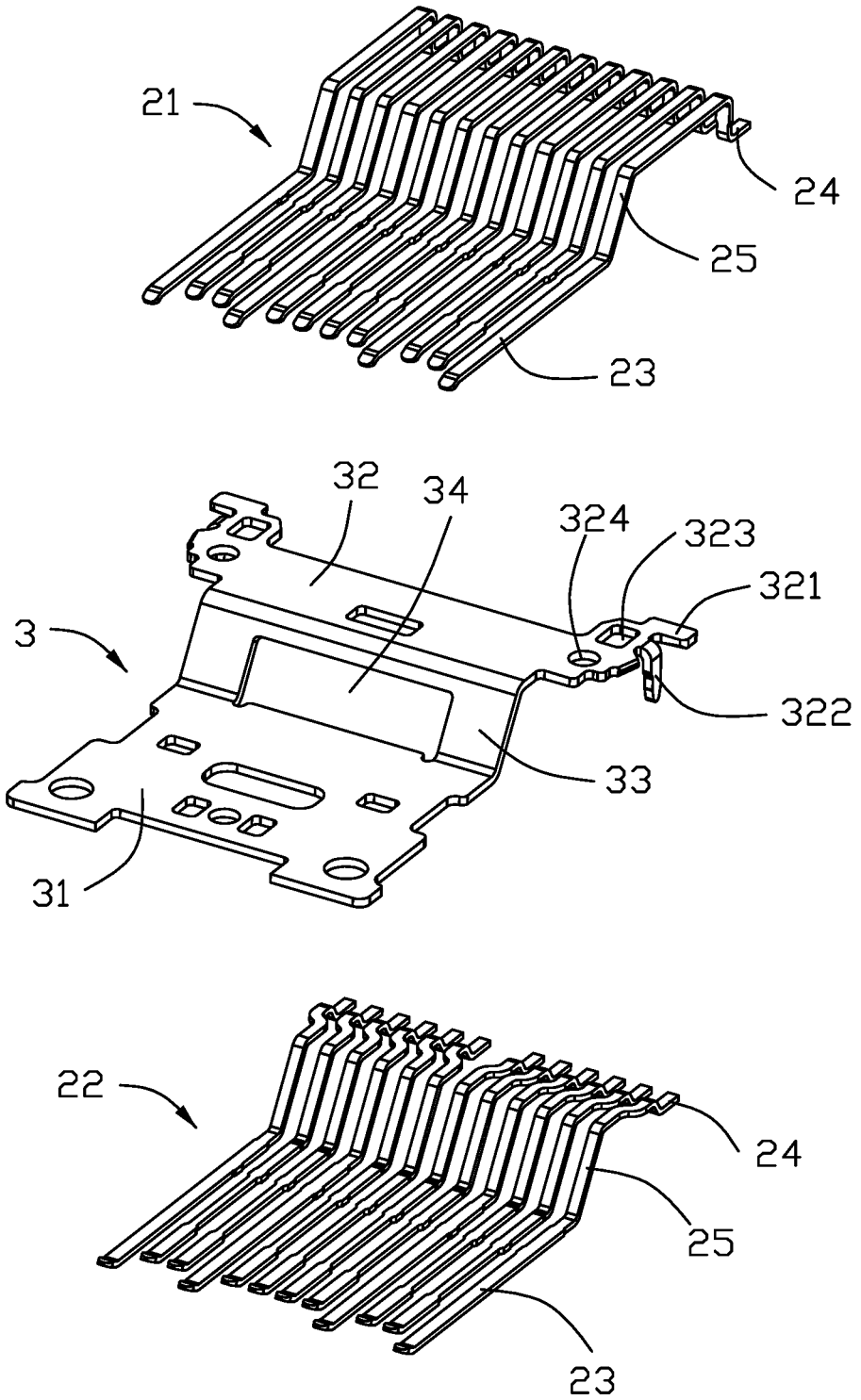
FIG. 9 is a partial exploded view of contacts and the metal shielding plate of the electrical connector.
Figure 10:
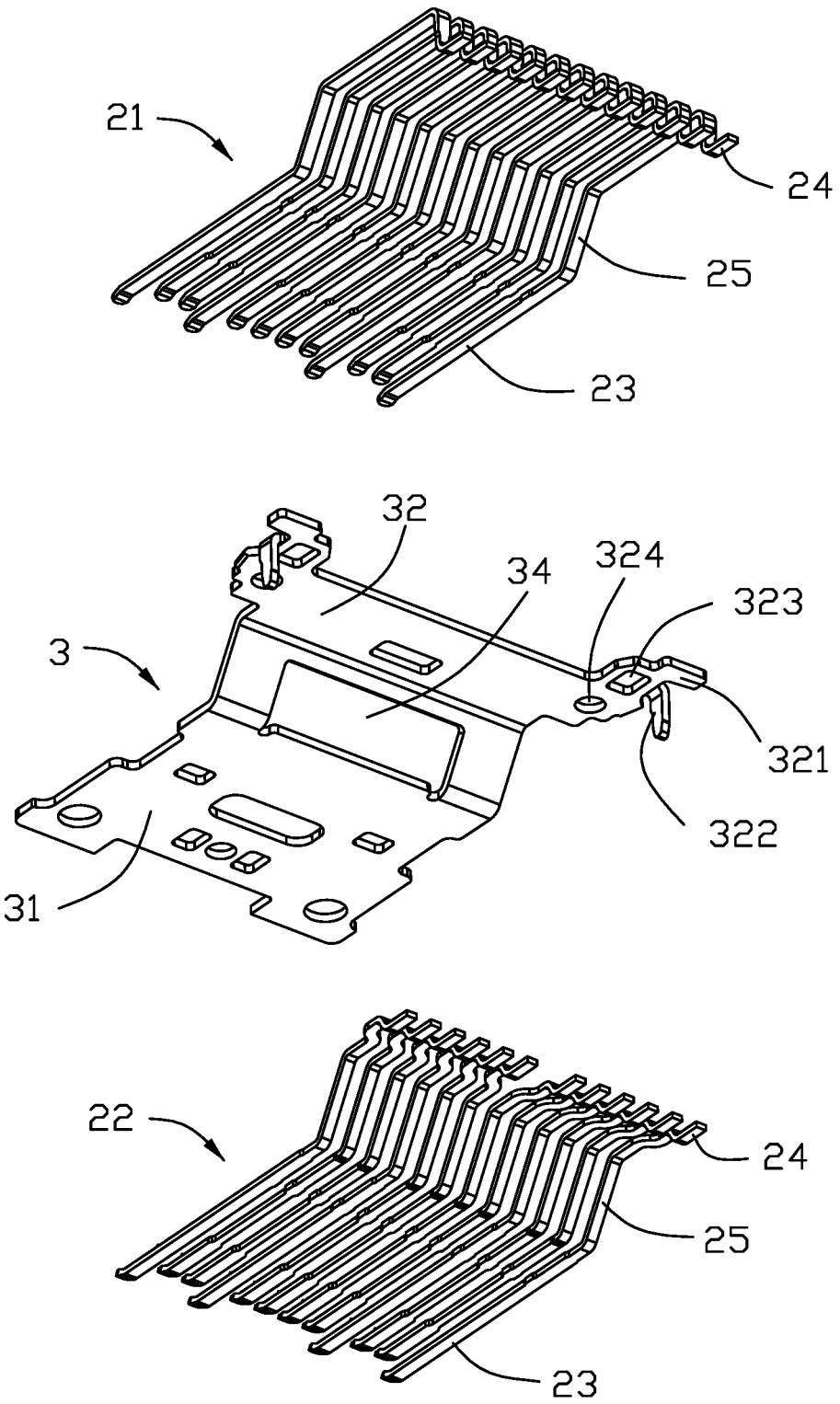
FIG. 10 is another perspective, exploded view of contacts and the metal shielding plate of the electrical connector taken from FIG. 9.
Figure 11:
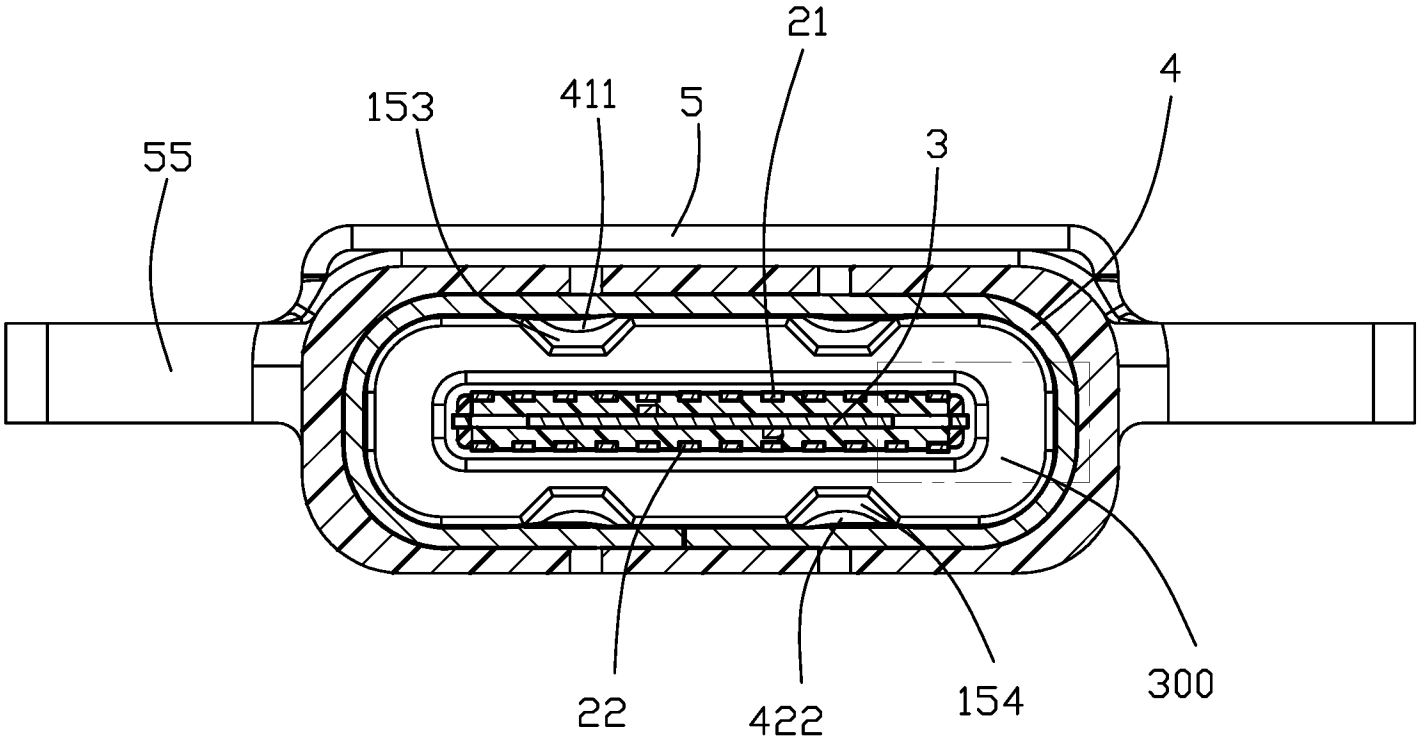
FIG. 11 is a cross-sectional view of the electrical connector taken along line 11-11 in FIG. 1.
Figure 12:
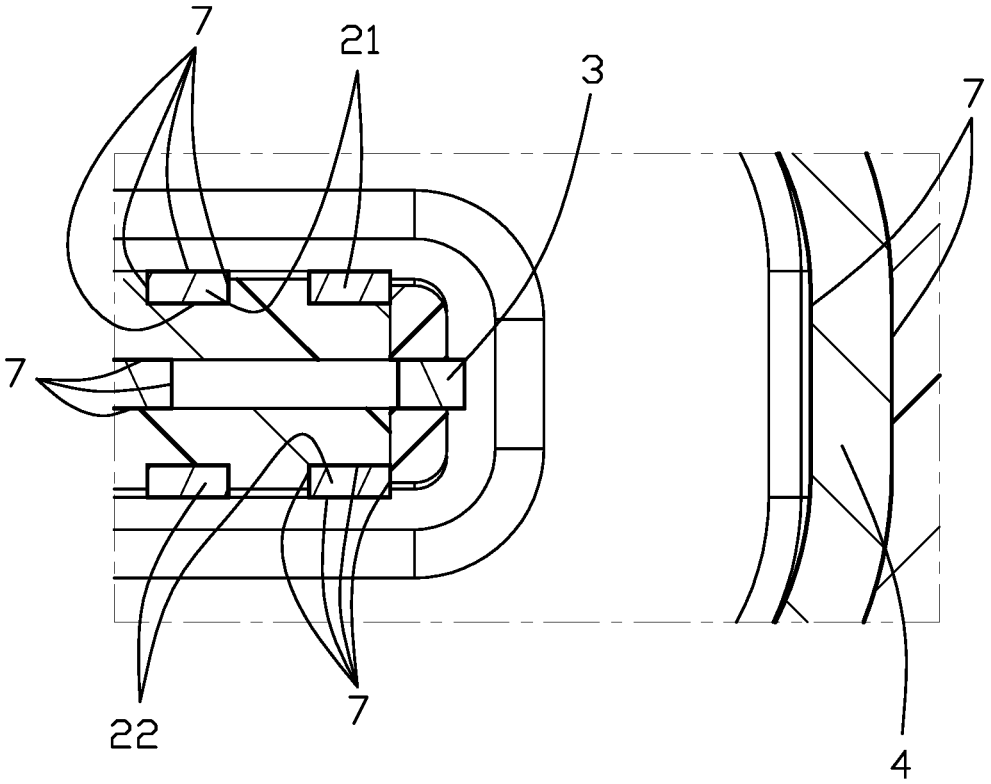
FIG. 12 is a partial enlarged view of FIG. 11.

Referring to FIGS. 9, 10, and 12, the plurality of contacts 2 includes upper contacts 21 and lower contacts 22. Each of the upper contacts 21 and the lower contacts 22 includes a contacting portion 23, a tail 24, and a fixed portion 25 connecting the contacting portion 23 and the tail 24. The upper contacts 21 and lower contacts 22 are equal in number. Each contacting portion 23 of the upper contacts 21 is positioned in reverse symmetry with respect to a respective one of the lower contacts 22. The contacts 2 are covered integrally by the thermostable conductive adhesives 7, and in other embodiments, only the fixed portion 25 is covered by thermostable conductive adhesives 7.

The metal shielding plate 3 includes a front portion 31, a rear portion 32, and a connecting portion 33. The connecting portion 33 includes a through hole 34 in the middle thereof. The rear portion 32 comprises a pair of fixed pins 321 located at a rear end thereof and extending to both sides, a pair of soldering pins 322 located at a front end of fixed pins 321 and bending downwardly, a pair of positioning holes 323, and a pair of third mated holes 324 located at a front end of positioning holes 323. The metal shielding plate 3 is covered by thermostable conductive adhesives 7.

Figure 5:
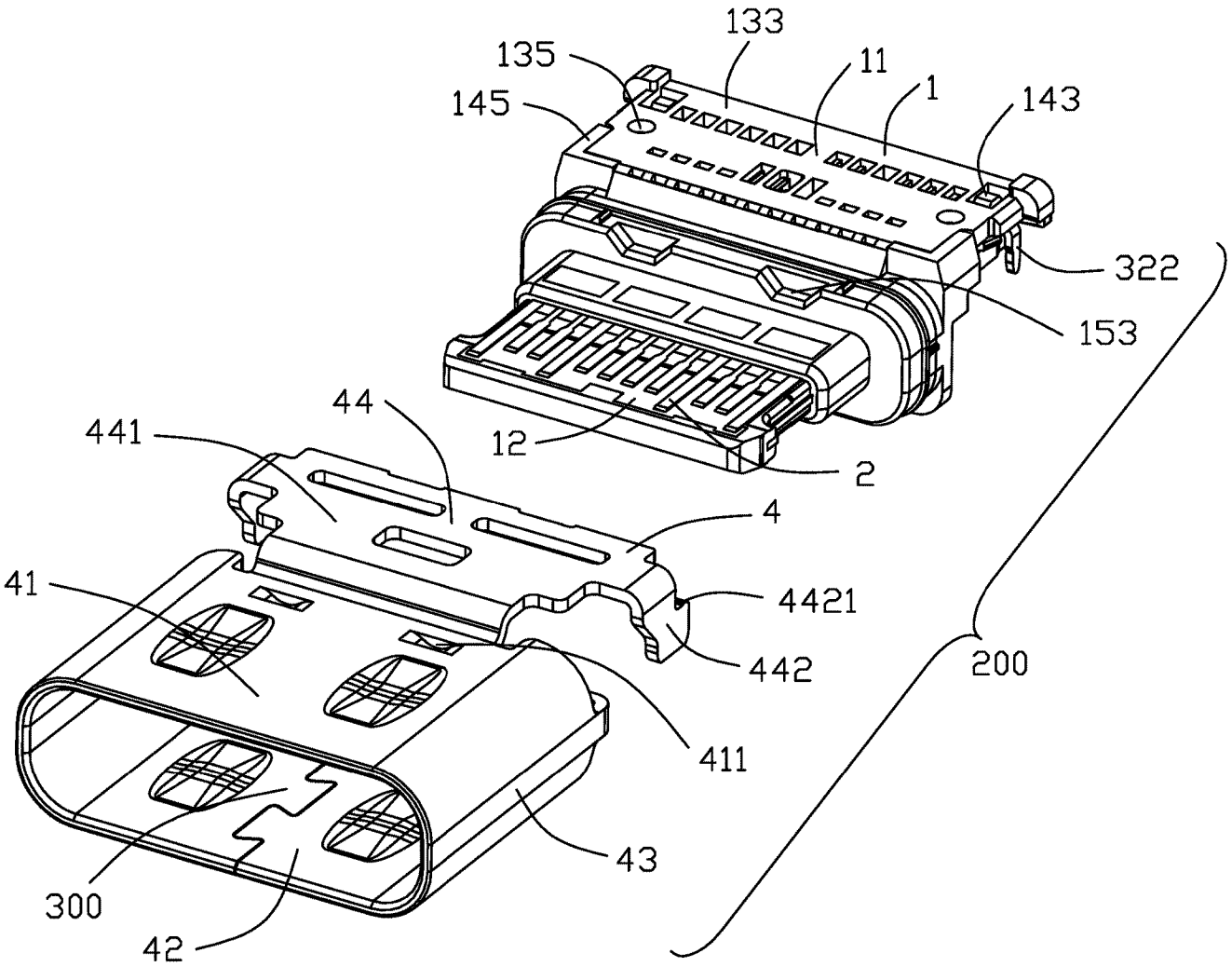
FIG. 5 is a partial exploded view of a receptacle connector of the electrical connector.
Figure 6:
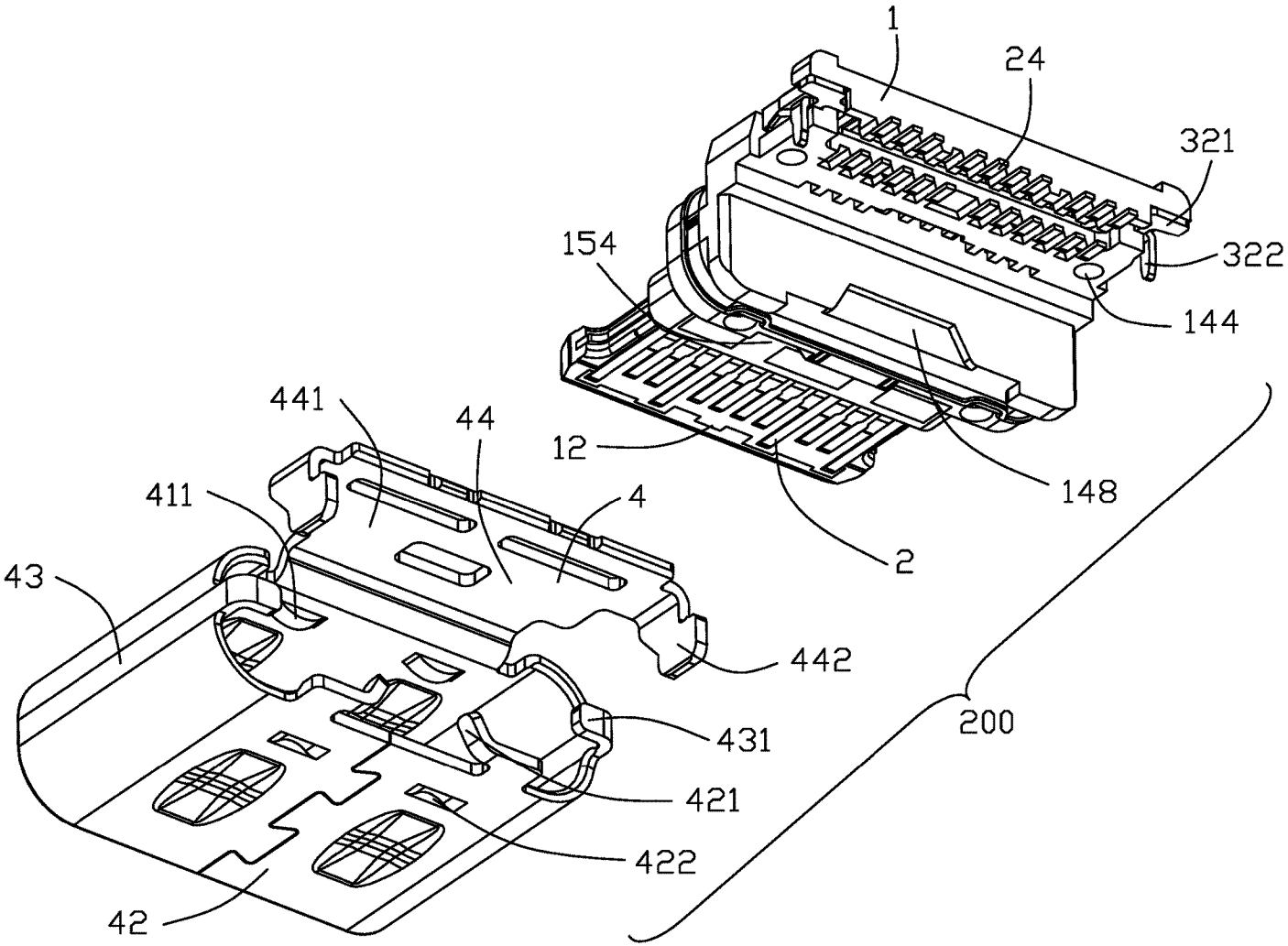
FIG. 6 is another perspective, exploded view of the receptacle connector of the electrical connector taken from FIG. 5.
Figure 7:
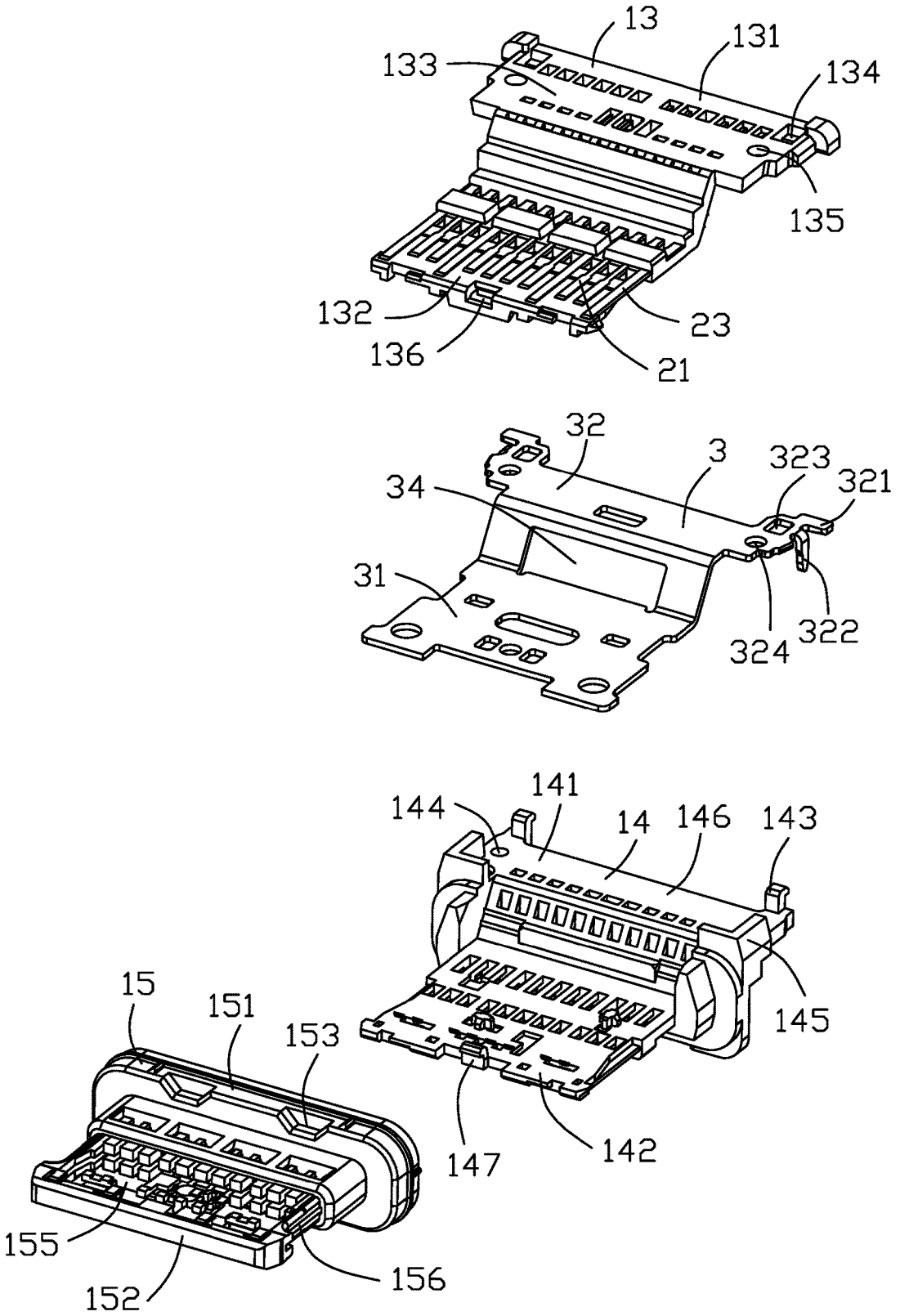
FIG. 7 is a partial exploded view of an insulative housing, contacts and a metal shielding plate of the electrical connector.
Figure 8:
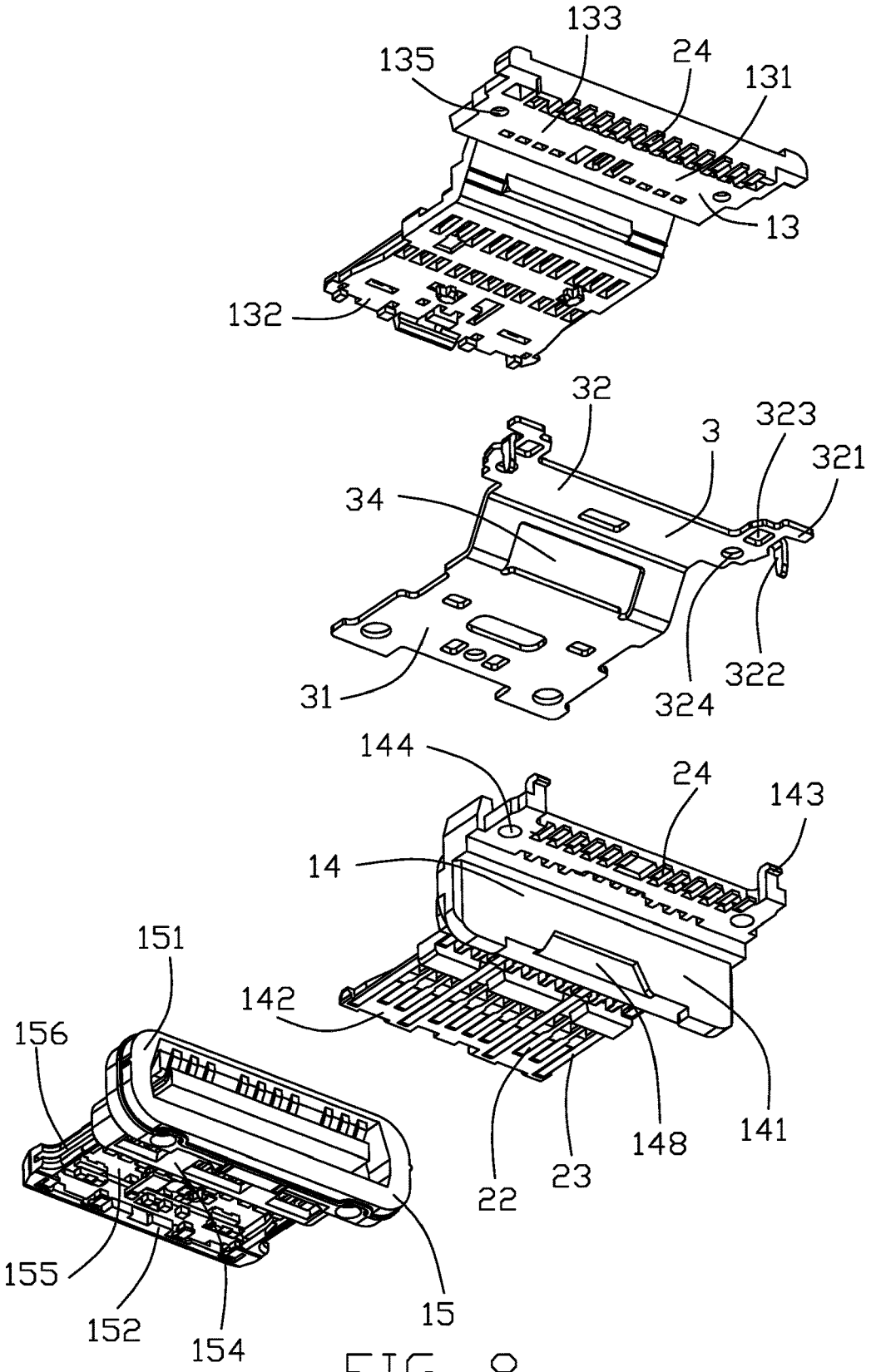
FIG. 8 is another perspective, exploded view of the insulative housing, contacts and the metal shielding plate of the electrical connector taken from FIG. 7.

Referring to FIGS. 5, 6, and 12, the shielding shell 4 includes an upper wall 41, a lower wall 42 opposite to the upper wall 41, and a pair of lateral walls 43 connecting the upper wall 41 and the lower wall 42 for forming a receiving room 300. The shielding shell 4 further includes a shielding sheet 44 extending rearward from a rear end of the upper wall 41. The upper wall 41 includes a pair of first protrusions 411 located at a rear end thereof. The lower wall 42 includes a pair of first bending parts 421 located at a rear end thereof and bending upwardly, and a pair of second protrusions 422 located at a front end of the pair of first bending parts 421. The lateral walls 43 include a pair of second bending parts 431 located at a rear end thereof and bent inwardly. The shielding sheet 44 includes a main portion 441 and a pair of fixed legs 442 extending downward from both sides of the main portion 441. Each fixed leg has a supporting portion 4421. The shielding shell 4 is covered by thermostable conductive adhesives 7.

Figure 3:
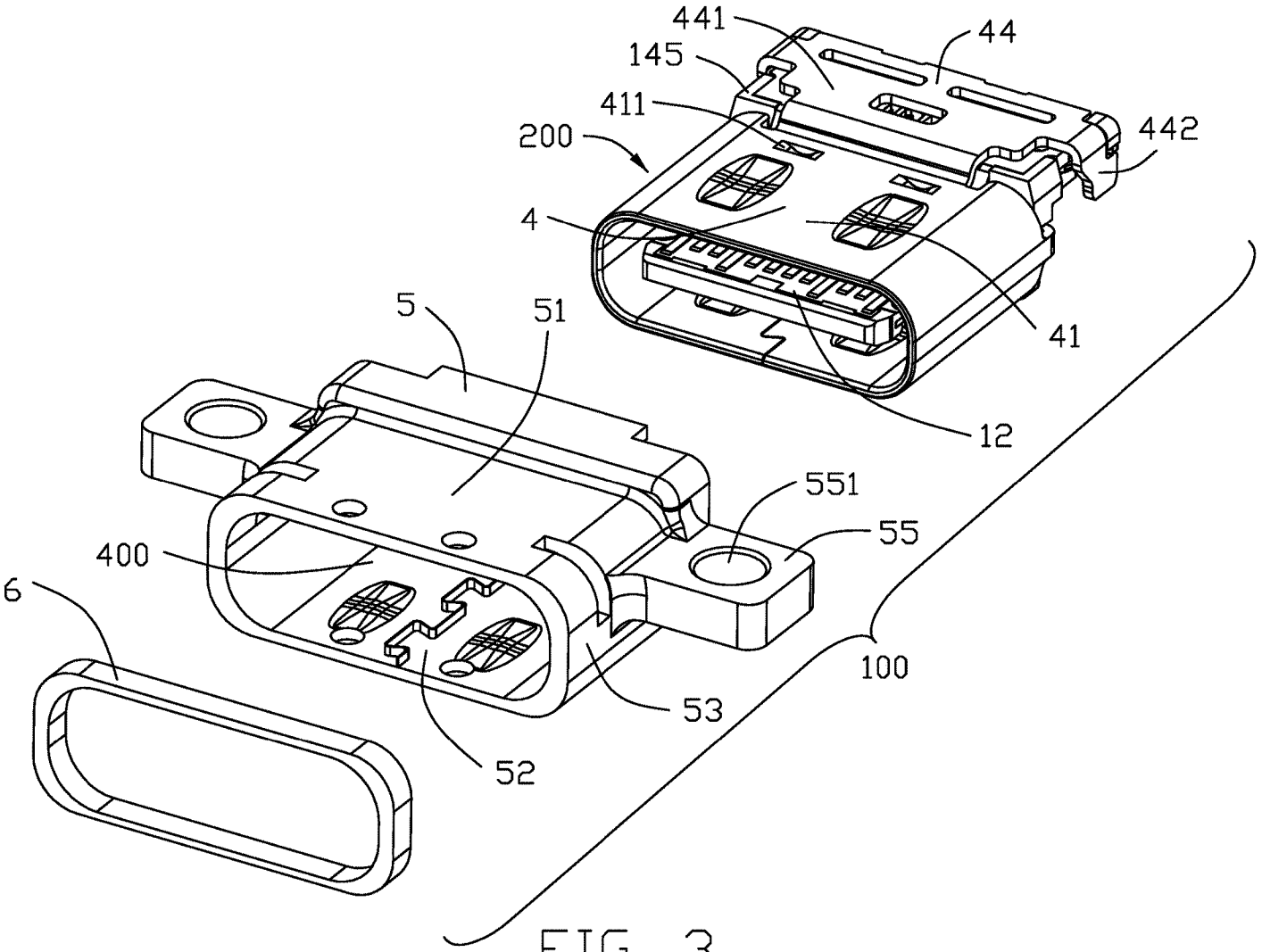
FIG. 3 is a partial exploded view of the electrical connector.
Figure 4:
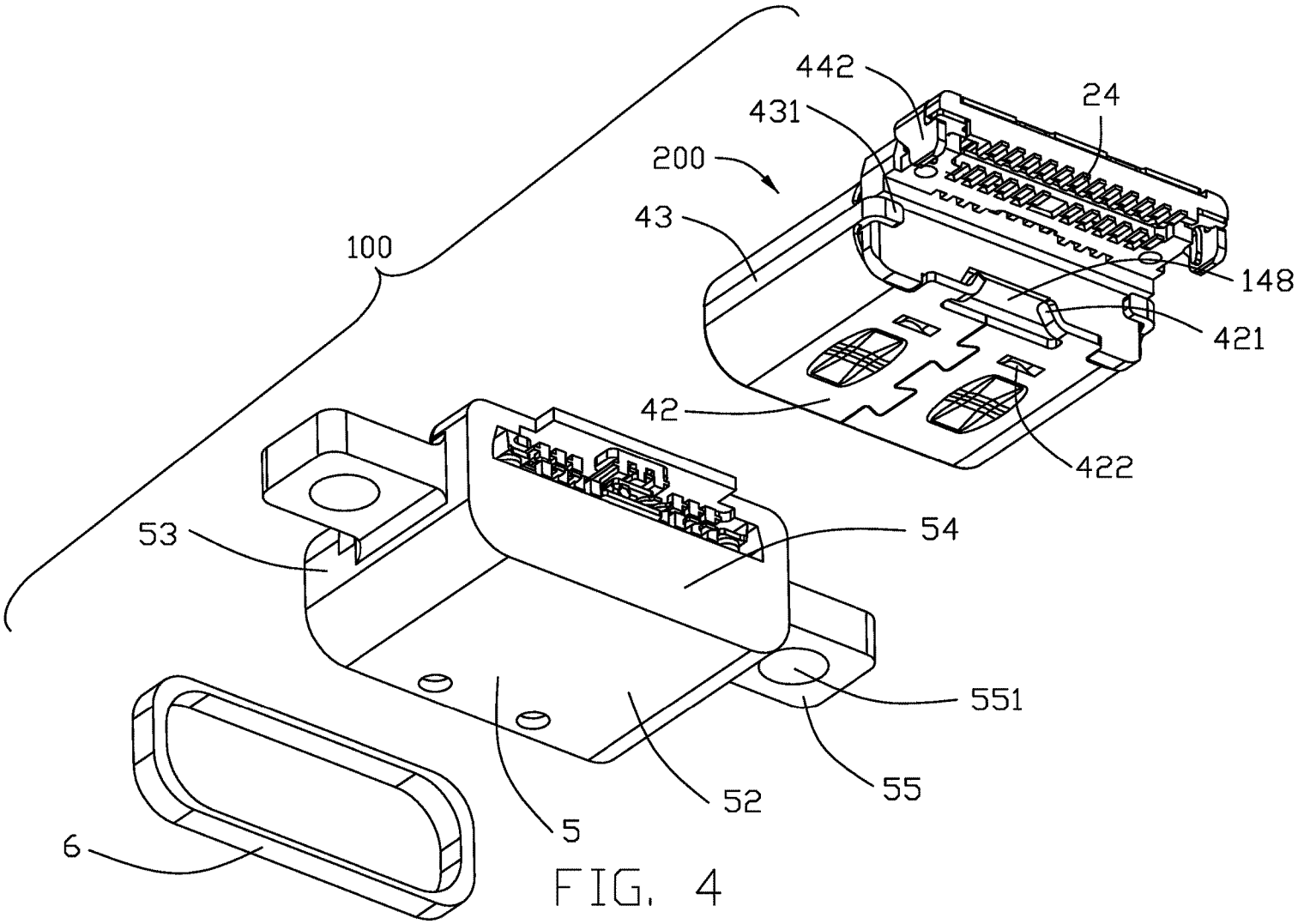
FIG. 4 is another perspective, exploded view of the electrical connector taken from FIG. 3.

Referring to FIGS. 3 and 4, the insulative shell 5 includes an upper plate 51, a lower plate 52 opposite to the upper plate 51, a pair of lateral plates 53 connecting the upper plate 51 and the lower plate 52 for forming a mating room 400. The insulative shell 5 further includes a pair of fixed sections 55 extending outwardly from both sides of the lateral plates 53 and a rear sealed portion 54 sealing a rear end thereof. Each fixed sections 55 has a penetrating hole 551. In other embodiments, a rear sealed portion 54 is not provided so that the insulative shell 5 is a through structure and the plastic plate is optionally injected to seal the rear end of the insulative housing 5.

The sealer 6 is generally in the shape of a racetrack.

The method of making the electrical connector comprises the following steps a through d.

In the step a, apply thermostable conductive adhesives 7 to cover the plurality of contacts 2 and the metal shielding plate 3, and affix the plurality of contacts 2 and the metal shielding plate 3 to an insulative housing 1.

Referring to FIGS. 5 to 8, the holding relationship between the contacts 2, the metal shielding plate 3, and the insulative housing 1 is as follows: the upper contacts 21 are affixed to the first insulator 13 to form an upper contact module via a first stage insert-molding process, the contacting portion 23 of the upper contacts 21 exposed to the first tongue 132, the fixed portion 25 of the upper contacts 21 fixed to the first base 131, and the tail 24 of the upper contacts 21 extending rearward from the first base 131. The lower contacts 22 are affixed to the second insulator 14 to form a lower contact module via another first stage insert molding process, the contacting portion 23 of the lower contacts 22 are exposed to the second tongue 142, the fixed portion 25 of the lower contacts 22 are fixed to the second base 141, and the tails 24 of the lower contacts 22 extend rearward from the second base 141. The metal shielding plate 3 is clamped between the first insulator 13 and the second insulator 14, the pair of second locking portions 143 are locked with the pair of first locking portions 134, the clamping block 147 is clamped with the locking hole 136, and the holding block 133 is located in the receiving space 146. The front portion 31 is clamped between the first tongue 132 and the second tongue 142 and extends laterally, the rear portion 32 is clamped between the first base 131 and the second base 141 so that the first mated holes 135, the second mated holes 144, and the third mated holes 324 are aligned in the vertical direction, respectively, and the through hole 34 receives the first insulator 13 and the second insulator 14 in contact with each other. The fixed pins 321 abut against a lower surface of the first base 131, the soldering pins 322 extend laterally between the first insulator 13 and the second insulator 14, and the positioning holes 323 are adapted for fitting of the second locking portions 143 and the first locking portions 134. The upper contact module and the lower contact module with the shielding plate therebetween are further integrally formed with a third insulator 15 to form the complete contact module wherein the first insulator 13 and the second insulator 14 and the third insulator 15 commonly form the whole insulative housing 1. The fixed groove 156 of the third insulator 15 corresponds to the front portion 31.

Referring to FIGS. 5, 6, 11, and 12, in the step b, apply thermostable conductive adhesives 7 to cover the shielding shell 4. The insulative housing 1 is arranged in the shielding shell 4 to form the receptacle connector 200. The shielding sheet 44 is disposed on the upper surface of the base portion 11. The fixed legs 442 are laterally surrounded by the insulative housing 1. The soldering pins 322 are attached to an inner surface of the fixed legs 442. The supporting surfaces 4421 of the fixed legs 442 are supported on a lower surface of the fixed pins 321. The pair of second bending parts 431 abut a rear surface of the lower half of the base portion 11 of the insulative housing 1. The first protrusions 411 are locked with the receiving grooves 153. The second protrusions 422 are locked with the recesses 154. The first bending parts 421 are locked with the notch 148.

In the step c, insert-mold the insulative shell 5 with the receptacle connector 200 to form the rear sealed portion 54 sealing a rear end of the insulative shell 5. In other embodiments, the insulative shell is assembled to the receptacle connector 200 and the plastic plate is located at a rear end of the receptacle connector 200 and seals a rear end of the insulative shell 5.

In the step d, the sealer 6 is attached to a front end of the insulative shell 5. Understandably, if the adhesives is insulative, the contacting section which is exposed to an exterior, should not be covered by the adhesives. In other words, maybe only the portion of the contact which is fully surrounded in the housing should be coated with the adhesives for assuring constant circumferential attachment between the contact and the housing to guarantee the reliable waterproof function.

What is claimed is:

1. An electrical connector comprising:

an insulative housing having a base portion and a tongue portion;

a plurality of contacts affixed to the insulative housing and exposed to the tongue portion;

a metal shielding plate affixed to the insulative housing; and a shielding shell enclosing the insulative housing;

wherein at least one of the plurality of contacts and the metal shielding plate is covered by thermostable conductive adhesives; and wherein the thermostable conductive adhesives seal between the base portion of the insulative housing and said at least one of the plurality of contacts and the metal shielding plate; and wherein the base portion comprises a pair of receiving grooves depressed downwardly from an upper surface thereof, a pair of recesses depressed upwardly from a lower surface thereof, and a notch located at a rear end of the pair of recesses and depressed upwardly; and the shielding shell comprises an upper wall, a lower wall opposite to the upper wall, and a shielding sheet extending rearward from a rear end of the upper wall, the upper wall having a pair of first protrusions at the rear end, the lower wall having a pair of first bending parts located at a rear end thereof and bent upwardly and a pair of second protrusions located at a front end of the pair of first bending parts, the shielding sheet including a main portion and a pair of fixed legs extending downward from both sides of the main portion, the first protrusions locked with the receiving grooves and the second protrusions locked with the recesses, the first bending parts locked with the notch, the shielding sheet disposed on the upper surface of the base portion, the fixed legs laterally surrounding the insulative housing.

2. The electrical connector as claimed in claim 1, wherein the plurality of contacts, the metal shielding plate, and the shielding shell are all covered by thermostable conductive adhesives.

3. The electrical connector as claimed in claim 1, wherein each of the plurality of contacts comprises a contacting portion exposed to the tongue, a tail extending rearward from the base, and a fixed portion connecting the contacting portion and the tail, and the fixed portion is covered by thermostable conductive adhesives.

4. The electrical connector as claimed in claim 1, further comprising an insert-molded insulative shell to form a rear sealed portion.

5. The electrical connector as claimed in claim 1, further comprising an insulative shell and a rear plastic plate, the plastic plate sealing a rear end of the insulative shell.

6. The electrical connector as claimed in claim 1, further comprising an insulative shell and a sealer attached to a front end of the insulative shell.

7. The electrical connector as claimed in claim 1, wherein the insulative housing comprises a first insulator and a second insulator, the first insulator comprises a first base and a first tongue extending forwardly from the first base, the second insulator comprises a second base and a second tongue extending forwardly from the second base, the first base comprises a pair of first mated holes, the second base comprises a pair of second mated holes, the metal shielding plate comprises a front portion, a rear portion, and a connecting portion, the rear portion comprises a pair of third mated holes, the front portion is clamped between the first tongue and the second tongue, the rear portion is clamped between the first base and the second base so that the first mated holes, the second mated holes, and the third mated holes are aligned in a vertical direction.

8. The electrical connector as claimed in claim 7, wherein the first base comprises a holding block and a pair of first locking portions on both sides of a rear end of the holding block, the first tongue comprises a locking hole located at a front end thereof, the second base comprises a pair of second locking portions located at a rear end thereof and extending upwardly from an upper surface thereof and a pair of stopper barriers located at a front end of second locking portions, the pair of stopper barriers are enclosed to form a receiving space, the second tongue comprises a clamping block located at a front end thereof and extending upwardly, the rear portion of the metal shielding plate comprises a pair of positioning holes, the second locking portions are locked with the first locking portions, the clamping block is clamped with the locking hole, the holding block is filled in the receiving space, the positioning holes are adapted for fitting of the second locking portions and the first locking portions.

9. An electrical connector comprising:

an insulative housing having a base portion and a tongue portion;

a plurality of contacts affixed to the insulative housing and exposed to the tongue portion;

a metal shielding plate affixed to the insulative housing; and a shielding shell enclosing the insulative housing;

wherein at least one of the plurality of contacts and the metal shielding plate is covered by thermostable conductive adhesives;

wherein the thermostable conductive adhesives seal between the base portion of the insulative housing and said at least one of the plurality of contacts and the metal shielding plate;

wherein the insulative housing comprises a first insulator and a second insulator, the first insulator comprises a first base and a first tongue extending forwardly from the first base, the second insulator comprises a second base and a second tongue extending forwardly from the second base, the first base comprises a pair of first mated holes, the second base comprises a pair of second mated holes, the metal shielding plate comprises a front portion, a rear portion, and a connecting portion, the rear portion comprises a pair of third mated holes, the front portion is clamped between the first tongue and the second tongue, and the rear portion is clamped between the first base and the second base so that the first mated holes, the second mated holes, and the third mated holes are aligned in a vertical direction; and wherein the first base comprises a holding block and a pair of first locking portions on both sides of a rear end of the holding block, the first tongue comprises a locking hole located at a front end thereof, the second base comprises a pair of second locking portions located at a rear end thereof and extending upwardly from an upper surface thereof and a pair of stopper barriers located at a front end of second locking portions, the pair of stopper barriers are enclosed to form a receiving space, the second tongue comprises a clamping block located at a front end thereof and extending upwardly, the rear portion of the metal shielding plate comprises a pair of positioning holes, the second locking portions are locked with the first locking portions, the clamping block is clamped with the locking hole, the holding block is filled in the receiving space, and the positioning holes are adapted for fitting of the second locking portions and the first locking portions.

* * * * *